US005941441A

United States Patent [19]

Ilagan

[11] Patent Number: 5,941,441

[45] Date of Patent: Aug. 24, 1999

[54] ELECTRIC NAILING GUN

[76] Inventor: Artemio M. Ilagan, P.O. Box 1815, Agana, Guam 96932

[21] Appl. No.: 09/037,656

[22] Filed: Mar. 10, 1998

[51] Int. Cl.[6] ..... B25C 5/00

[52] U.S. Cl. ..... 227/131; 227/132

[58] Field of Search ..... 227/131, 132, 227/134, 120

[56] References Cited

U.S. PATENT DOCUMENTS

| | | | |
|---|---|---|---|
| D. 260,354 | 8/1981 | Proops et al. . | |
| 1,655,275 | 1/1928 | La Place | 227/132 |
| 2,746,043 | 5/1956 | Heller | 227/132 |
| 3,243,093 | 3/1966 | Schaefer, Jr. et al. . | |
| 3,305,156 | 2/1967 | Khan | 227/131 |
| 3,552,627 | 1/1971 | Moreno . | |
| 3,586,231 | 6/1971 | Wilson | 227/132 |
| 3,589,588 | 6/1971 | Vasku | 227/131 |
| 4,679,975 | 7/1987 | Leistner . | |
| 4,724,992 | 2/1988 | Ohmori | 227/132 |
| 4,863,089 | 9/1989 | McCardle et al. . | |
| 5,118,023 | 6/1992 | Fushiya et al. | 227/131 |
| 5,219,110 | 6/1993 | Mukoyama . | |
| 5,495,973 | 3/1996 | Ishizawa et al. . | |
| 5,551,621 | 9/1996 | Vallee . | |
| 5,564,614 | 10/1996 | Yang . | |
| 5,653,371 | 8/1997 | Hou . | |

*Primary Examiner*—Scott A. Smith
*Attorney, Agent, or Firm*—Richard C. Litman

[57] ABSTRACT

An electric nailing gun powered by either A.C. or D.C. and utilizes T-shaped nails. A hammer motivated by a dual spring mechanism is compressed by a mechanical system comprising an electric motor driving on one end two cog wheels, a cam, and a pivoting lever to compress the dual spring mechanism. The opposite end of the motor has a rotating scooper plate which catches a knob on the hammer to compress and release the compressed hammer to drive in the T-shaped nails from a bar of nails in a magazine.

4 Claims, 7 Drawing Sheets

ELECTRIC NAILING GUN

BACKGROUND OF THE INVENTION

1. Field of the Invention

The present invention relates generally to an electric nailing gun utilizing T-shaped nails. Specifically, a motor driven scooper gear and a cam operating on a pivoting lever cocks a dual spring driven hammer for driving in T-shaped nails from a bar.

2. Description of the Related Art

The related art of interest describe various nailing guns. The related art will be discussed in the order of perceived relevance to the present invention.

U.S. Pat. No. 3,552,627 issued on Jan. 5, 1971, to Angel Moreno describes a pistol shaped electrically operated hammer and nail driver in which nails are fed from a horizontal side magazine and driven forward by a horizontally aligned hammer. The hammer is energized by a solenoid having reversely wound double coils including an axially reciprocal armature. A reversing switch in the path of the hammer supplies current to the double coils of the solenoid to cause reciprocation of the hammer. The electric hammer assembly is distinguishable by its reliance on a solenoid for reciprocation of the hammer and a hand gun casing.

U.S. Pat. No. 5,653,371 issued on Aug. 5, 1997, to Chang Feng-Mei Hou describes a longitudinally aligned magazine for a power nail gun positioned parallel to the handle and comprising a case for holding a bar of T-shaped nails and pushing forward with a follower plate connected to two compression springs. The magazine is distinguishable by its reliance on two compression springs and a follower plate instead of the simpler ribbon spring of the present invention. Moreover, the loading port is located on a side of the magazine due to the compression springs rather than the rear as in the present invention. There is no description of the inner structure of the power nail gun as to mechanical parts.

U.S. Pat. No. 3,243,093 issued on Mar. 29, 1966, to Hans F. Schaefer, Jr. et al. describes a pistol shaped impact tool with a tuned spring of a helical torsion type actuating a hammer reciprocally mounted to deliver blows to advance a driver stepwise by a conjugate, wobble type cam with a circular recessed track. A tubular member or housing detachable from the handle with its torsion spring houses a stop, a hammer with a driver end housing a knob of the torsion spring, a driver with a collar held by the arms of a guide, and a slidable nail package fed at the nosepiece of the tube. The tool is distinguishable for its dissimilar torsion spring cam and its slidable ecentrically aligned nail pack structure from the present invention.

U.S. Pat. No. 5,495,973 issued on Mar. 5, 1996, to Yoshinori Ishizawa et al. describes a pneumatically operated single nail gun with a safety device for preventing accidental firings. The pneumatic actuating mechanism for driving only a single nail at a time and the safety device are dissimilar from the present invention.

U.S. Design Pat. No. 260,354 issued on Aug. 25, 1981, to Richard Proops et al. describes a nailer device having a nail casing angled from the longitudinal axis of the nailer body and inclined from beyond the handle to the nailing end of the nailer body. The housing is thus distinguishable from the present invention.

U.S. Pat. No. 4,679,975 issued on Jul. 14, 1987, to Herbert E. Leistner describes a nailing strip for use in a power-operating nailing hammer and having a plurality of nails arranged to incline and their shanks fastened by a pair of parallel junction wires which are each covered by a sheath. The present invention neither aligns the T-nails in such an inclined position nor require wires and sheaths to form a bar of nails.

U.S. Pat. No. 4,863,089 issued on Sep. 5, 1989, to Thomas A. McCardle et al. describes a flagless nail driving pneumatic tool utilizing a coil of collated nails joined by two parallel wires welded to the nail shanks. The collated wires eliminate the formation of loose pieces of collating wires and the trapping of the wires under the heads of driven nails to form flags. The nail driving tool is distinguishable for its pneumatic drive mechanism and the wire collated nails.

U.S. Pat. No. 5,219,110 issued on Jun. 15, 1993, to Kenji Mukoyama describes a mechanism for adjusting the driving depth of fasteners in a pneumatic driving tool including a driver guide. The mechanism includes a cam device with a circumferential series of inclined saw tooth-like recesses in a lower cam member cooperating with a smaller cylindrical upper cam member with a bottom protrusion interfitting between the recesses of the lower cam member's saw teeth. The distinctive cam structures and their functions are dissimilar to the single cam of the present invention.

U.S. Pat. No. 5,564,614 issued on Oct. 15, 1996, to Peter Yang describes a nail adjusting mechanism for pneumatic nail guns. The mechanism includes a firing control strip which releases the firing pin. The firing control strip has two lugs with a toothed adjusting wheel between them. A safety bar with a threaded rod is inserted through the lugs and the adjusting wheel. Rotation of the wheel displaces the threaded rod and moves the safety bar. The nail depth adjusting mechanism is distinguishable from the present invention because there is no need for such a mechanism.

U.S. Pat. No. 5,551,621 issued on Sep. 3, 1996, to Glenn E. Vallee describes a pneumatic powered nail driving tool with an improved trigger assembly with a control structure which is manually movable between a sequential operating mode position and a contact mode position. The control structure and a workpiece contact responsive assembly cooperate to define an actuation prevention structure arranged to prevent more than one cycle of tool operation from occurring during the sequential operating mode when only a single cycle of tool operation is intended. The tool is distinguishable by its pneumatic drive means and the dissimilar trigger assembly.

None of the above inventions and patents, taken either singularly or in combination, is seen to describe the instant invention as claimed. Thus, a dependable electric nailing gun utilizing a unique hammer, scooper plate and cam assembly to drive T-shaped nails is desired.

SUMMARY OF THE INVENTION

An electric nailing gun is powered by either A.C. or D.C. and utilizes T-shaped nails. A hammer motivated by a dual spring mechanism is compressed by a mechanical system comprising an electric motor driving on one end two cog wheels, a cam, and a pivoting lever to compress the dual spring mechanism. The opposite end of the motor has a rotating scooper gear which catches the hammer for compression and releases the compressed hammer to drive in the T-shaped nails formed as a bar or a train of nails.

Accordingly, it is a principal object of the invention to provide an electric nailing gun which drives in T-shaped nails.

It is another object of the invention to provide an electric nailing gun with a motor driven scooper gear for catching and releasing the hammer.

It is a further object of the invention to provide an electric nailing gun which drives the hammer with a dual spring set.

Still another object of the invention is to provide an electric nailing gun with two cog wheels which rotate a cam for driving the lever which compresses the dual spring set.

Yet another object of the invention is to provide a bar of T-shaped nails having a specialized biting head having a triangular cross-section.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
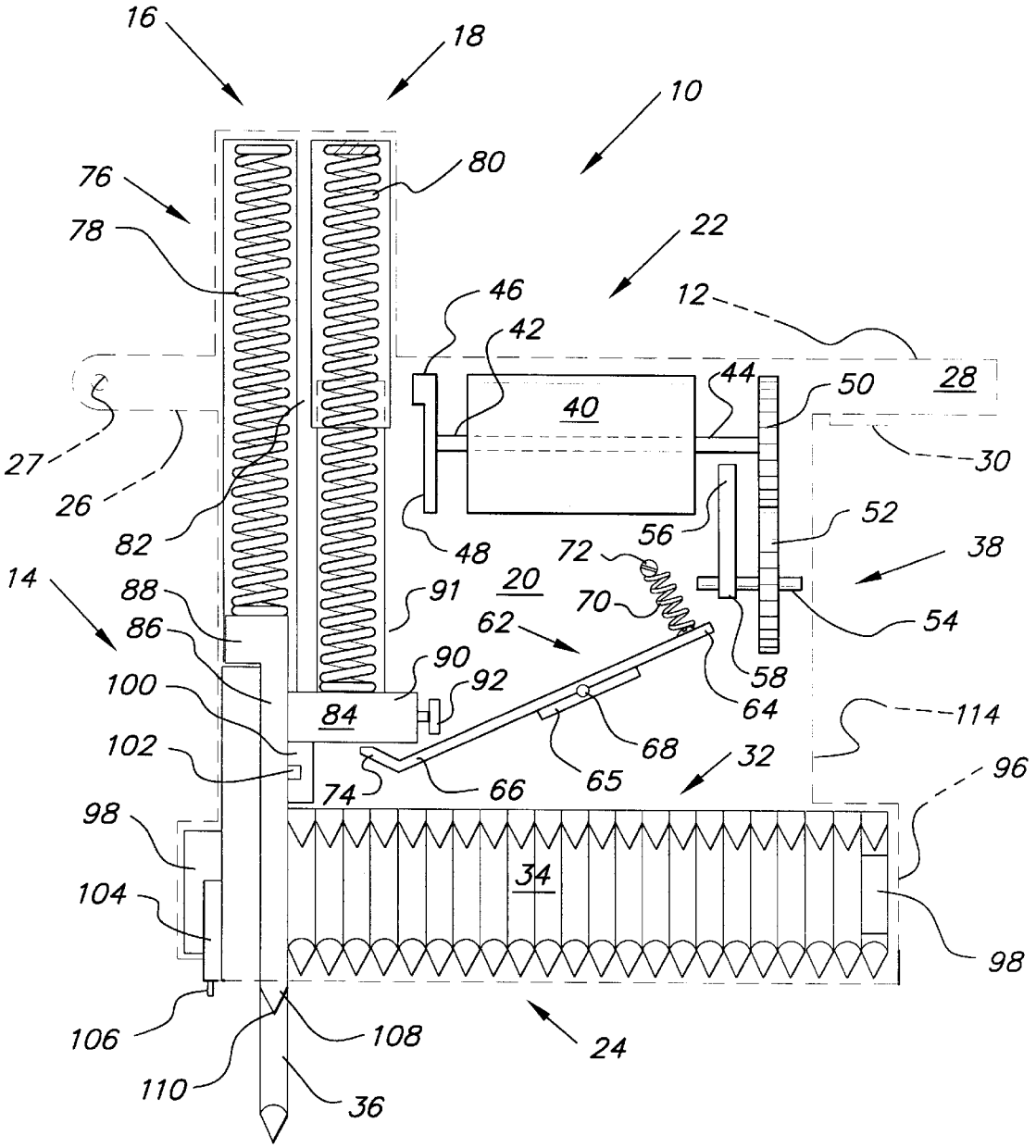
FIG. 1 is a right side schematic diagram of the electric nailing gun (with the case in shadow) after one T-nail from a ram has been driven out according to the present invention.
Figure 2:
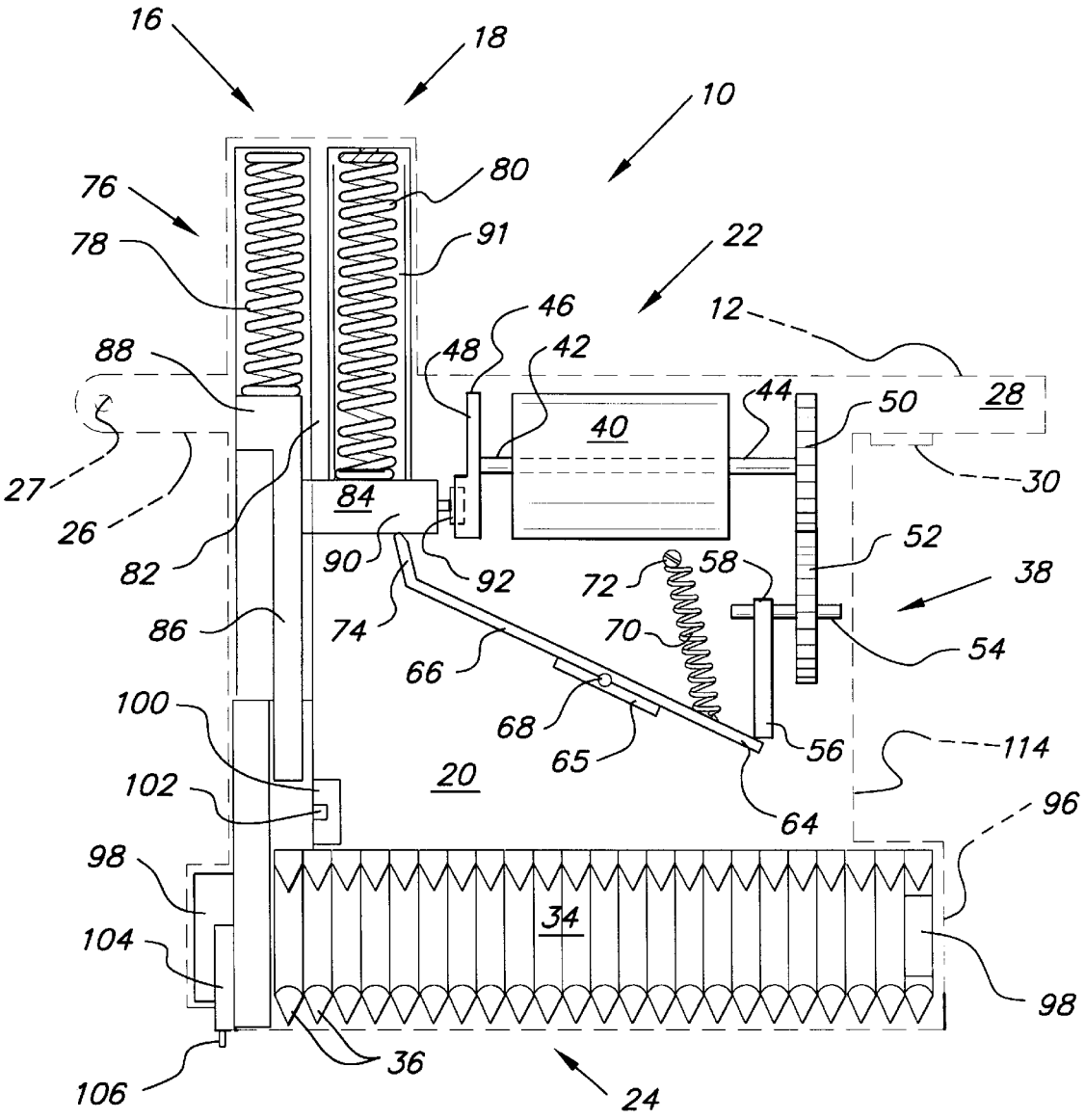
FIG. 2 is a right side schematic diagram of the electric nailing gun (with the case in shadow) with the hammer in a cocked condition.
Figure 3:
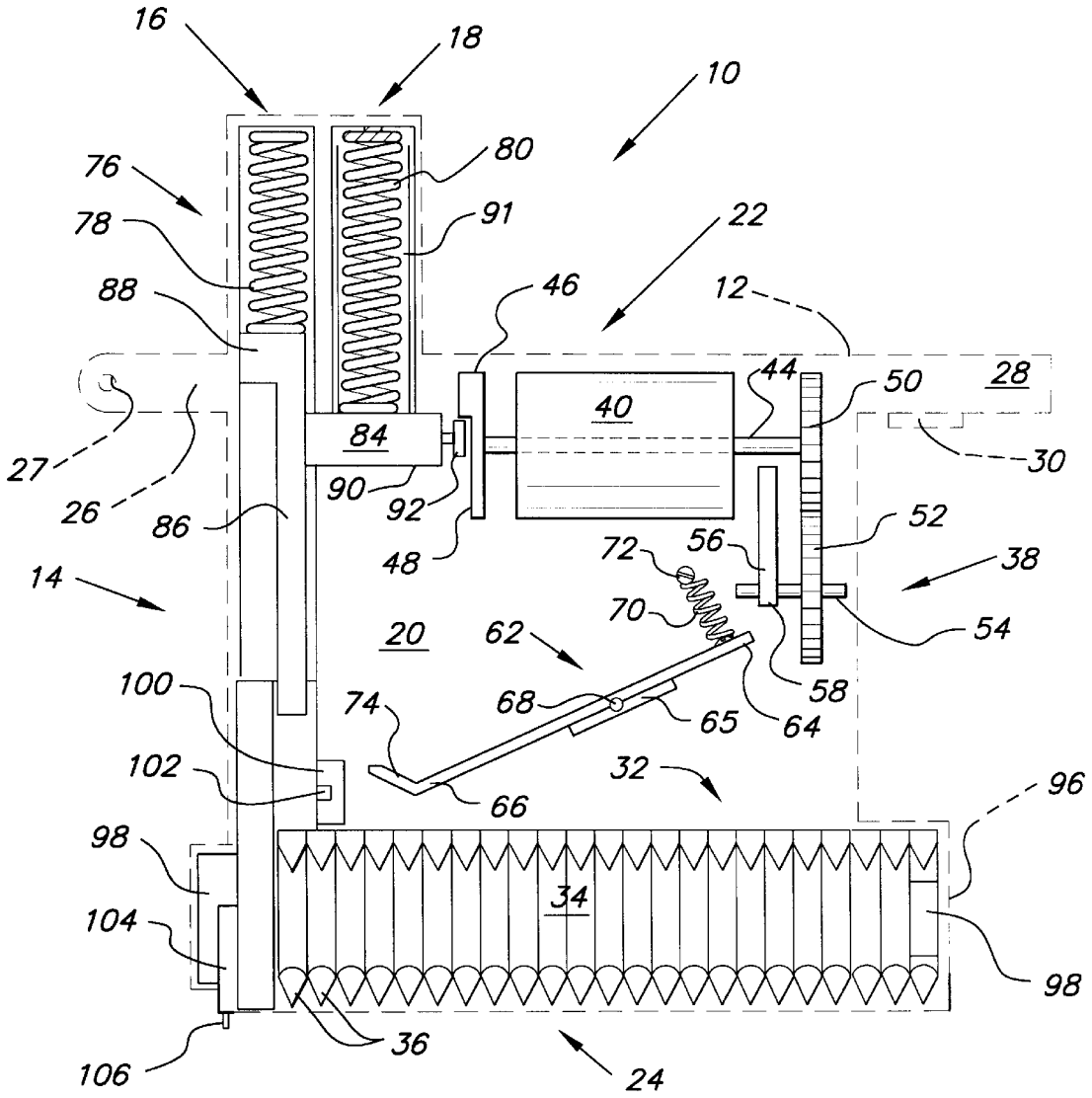
FIG. 3 is a right side schematic diagram of the electric nailing gun (with the case in shadow) with the hammer in an uncocked condition just before the nail driving in process begins.

The present invention provides a dependable electric nailing gun device 10 shown schematically with the casing 12 in shadow in FIGS. 1, 2 and 3. The casing 12 has a front end 14, a first front stack 16 with a square cross-section, a second shorter rear cylindrical stack 18, a main body 20 with a top portion 22 and a bottom portion 24, a wide front handle 26 with an aperture 27 for hanging the tool 10, a thin rear handle 28 with a trigger 30, a case 32 for a bar or train 34 of T-shaped nails 36, and a rear end 38 for enclosing the mechanical parts of an electrical nailing gun. An electric motor 40 having a front drive axle 42 and a rear drive axle 44 is located in the top portion 22 of the main body 20. The motor 40 can be energized by either alternating current or by a rechargeable battery (not shown) either inside or attachable to the rear handle 28. It should be noted that the conventional wiring has been omitted in FIGS. 1–3.

A circular scooper plate 46 is attached perpendicularly to and driven by said front drive axle 42, and has an arcuate groove 48 beginning from an edge as a shallow groove and spiralling towards the center of the circular scooper plate 46.

Figure 4A:
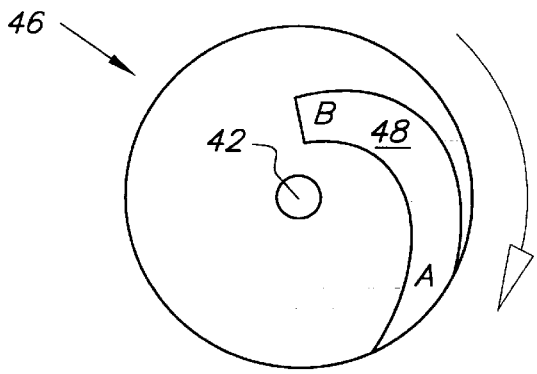
FIG. 4A is a top plan view of a scooper plate.
Figure 4B:
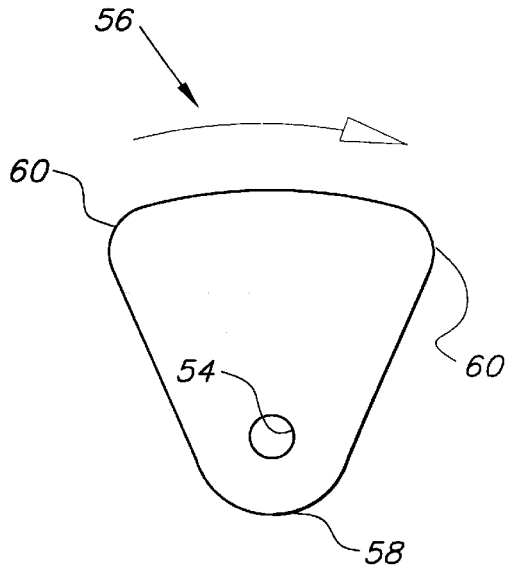
FIG. 4B is a top plan view of a cam.

A first cog wheel 50 driven by the rear drive axle 44 drives a second cog wheel 52 on an axle 54 which supports a substantially triangular cam 56 having a rounded apex 58 and base corners 60 and connected at the apex 58 (FIG. 4B).

An elongated lever 62 having a rear end 64 and a front end 66 pivots on a pivot pin 68 as a fulcrum in a middle portion, but located closer to the rear end 64 of the lever 62. A short reinforcement plate 65 below the pivot pin 68 is added to the lever 62. A spring 70 has one end attached to the rear end 64 of the lever 62 and its opposite end anchored to a post 72 positioned between the walls of the tool casing 12. The front end 66 of the lever 62 is formed with an upwardly directed lip portion 74. Although the mechanical advantage of this lever system appears detrimental, the longer length of the lipped portion of the lever 62 is required for a larger arc of travel to compress a dual compression spring element 76.

The dual compression spring element 76 having a front compression spring 78 and a rear compression spring 80 separated by a guide 82 are positioned vertically in stacks 16 and 18, respectively, at the front end 14 of the casing 12. A hammer element 84 comprising a stem 86 with a rectangular cross-section for driving in T-shaped nails 36, The hammer element 84 has a first top portion 88 forwardly projecting for anchoring the front spring 78 and a second portion 90 proximate the top portion 88 projecting rearwardly from the stem 86 to anchor the rear spring 80. A cylinder 91 is attached to the upper surface of the second portion 90 and fits slidingly within the short cylindrical rear stack 18. The projecting second portion 90 ends in a knob 92 for interfitting the arcuate groove 48 in the scooper plate 46. A bar or train 34 of T-shaped nails 36 is stored horizontally in the nail case or magazine 32. An access cover 96 at the rear end of the nail case or magazine 32 is available for reloading a fresh full bar 34.

An elongated ribbon spring 98 extending from the front end 14 of the casing 12 and hooked around the bar 34 provides the force to maintain the front T-nail 36 and the bar 34 against a slot (hidden) in the guide 82.

A stopper block 100 stops the hammer element 84 at its lowest position and a stop switch 102 incorporated therein automatically turns off the electrical power to the motor 40.

A safety switch 104 with a push button 106 is provided in the bottom portion 22 of the front end 14 for operation of the device 10 only when depressed and pressed against a workpiece. When the device 10 is lifted from the workpiece, the safety switch 104 operates to automatically deenergize the motor 40.

Figure 5:
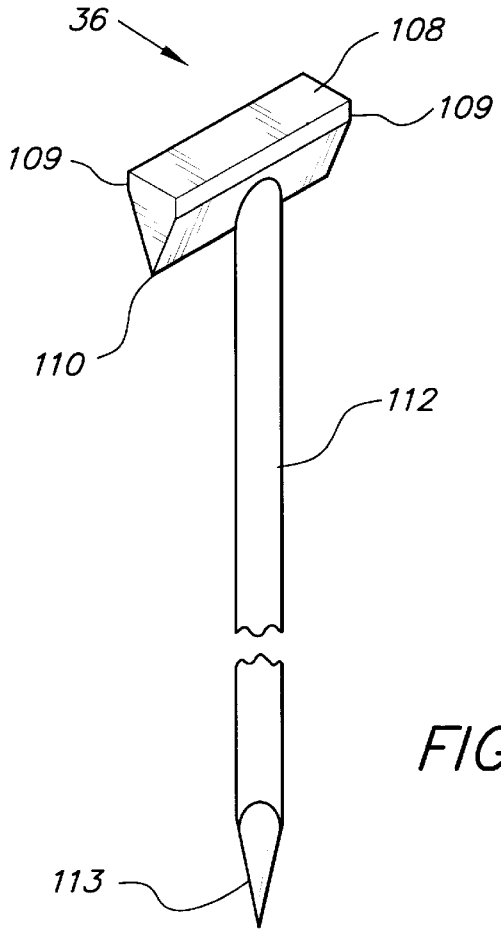
FIG. 5 is an elevated perspective view of a T-shaped nail with the head having a biting triangular cross-section.
Figure 6:
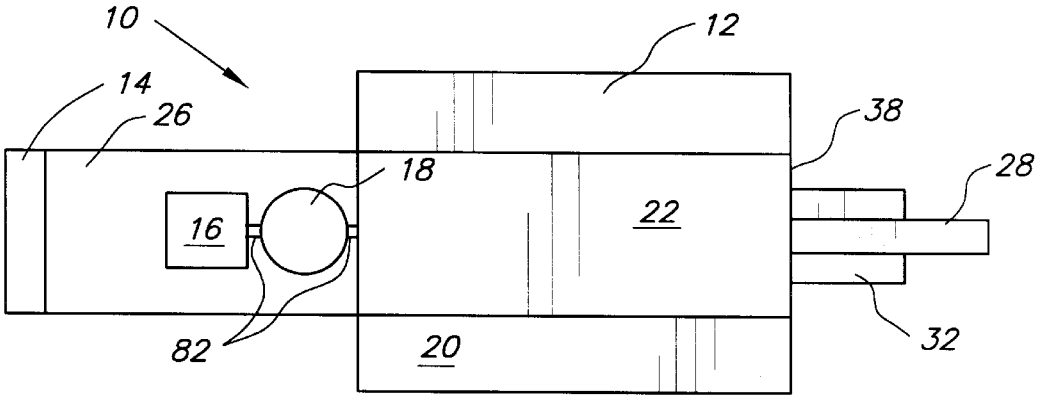
FIG. 6 is a top plan view of the nailing gun casing.
Figure 7:
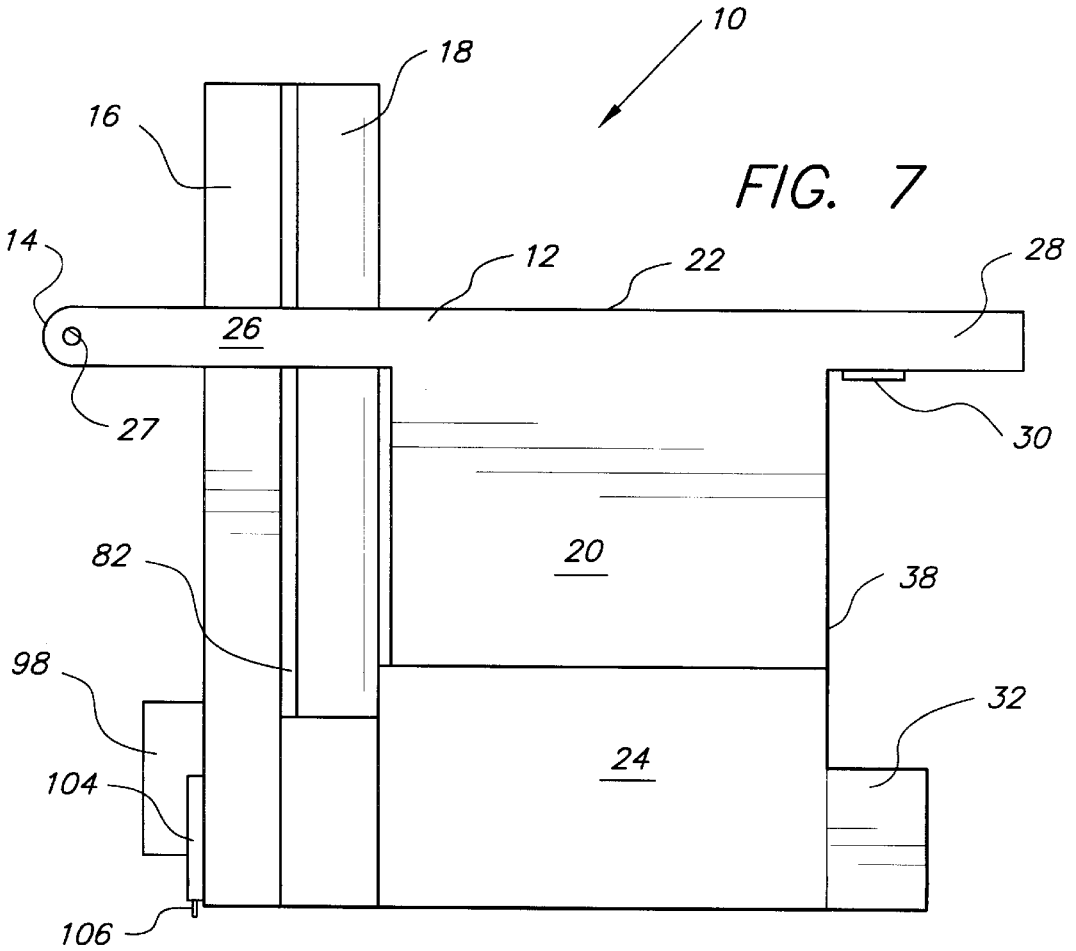
FIG. 7 is a right side view of the nailing gun casing.

The mechanical operation of the electric nailing gun device 10 can be explained with reference to FIGS. 1 to 3. In FIG. 1, the device 10 has just driven in a T-nail 36 having a flat topped head 108 (FIG. 5) triangular in cross-section with flat connecting sides 109, a biting edge 110, a cylindrical nail body 112, and a sharp nail point 113. The trigger 30 (FIGS. 7 and 8B) under the rear handle 28 has been depressed to energize the motor 40 in rotating the scooper plate 46 in the direction shown by the arrow to move from an outer point A to the inner exit point B (FIG. 4A) to release the knob 92 of the hammer element 84. The cam 56 has no contact with the rear end 64 of the lever 62. The stopper block 100 is in contact with the second projecting portion 90 of the hammer element 84.

In FIG. 2, the motor 40 continues to run and rotates the cam 56 in the direction of the arrow in FIG. 4B to contact the rear end 64 of the lever 62, stretching the spring 70 and tilting the lever's lip 74 upwards to contact the base of the second projecting portion 90 of the hammer element 84. The dual compression spring element 76 is consequently compressed for another strike by further rotation of the cam 56 through the rotation of the first and second cog wheels 50, 52 to cause the lever 62 to push up the hammer element 84 with the lip 74. This action compresses the dual springs 78, 80 and causes the knob 92 to contact the scooper plate 46 at Point A to be trapped and moved along the arcuate groove 48 (FIG. 4A).

Turning now to FIG. 3, the knob 92 of the second projecting portion 90 of the hammer element 84 is exiting point B of the arcuate groove 48 of the scooper plate 46 (FIG. 4A) and releasing its hold on the hammer element 84. The cam 56 has now rotated to release the rear end 64 of the lever 62 which is pulled up by the contraction of the spring 70 and causing the lip 74 of the lever 62 to pivot away from the hammer element 84. The hammer element 84 is now poised to drive in a T-shaped nail 36. It should be noted that the nailing operation will repeat until the trigger 30 is released. The repeating action will be explained with reference to the circuit diagram of FIG. 9 which is discussed below.

Figure 8A:
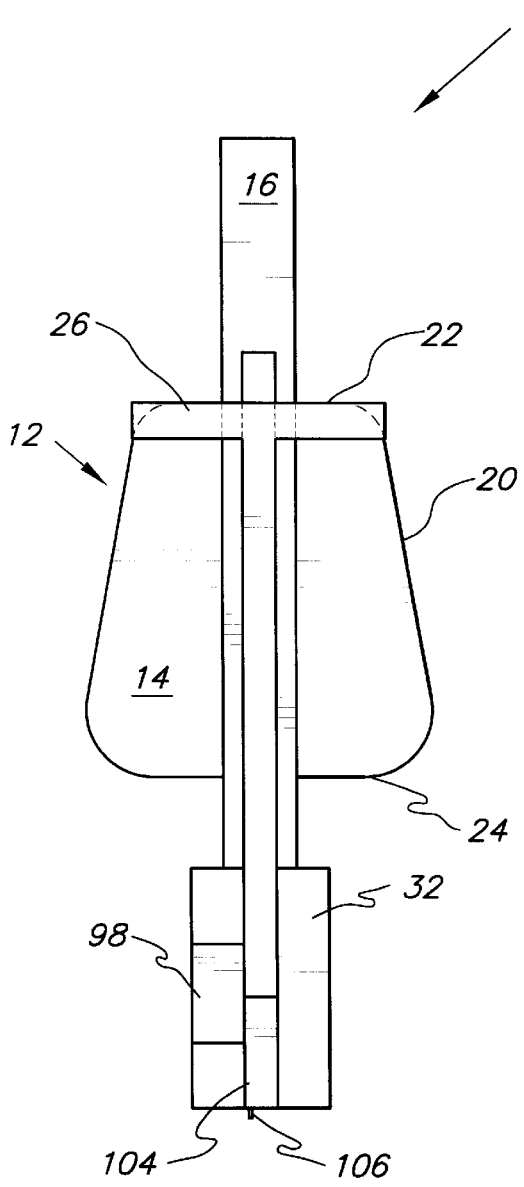
FIG. 8A is a front view of the nailing gun casing.
Figure 8B:
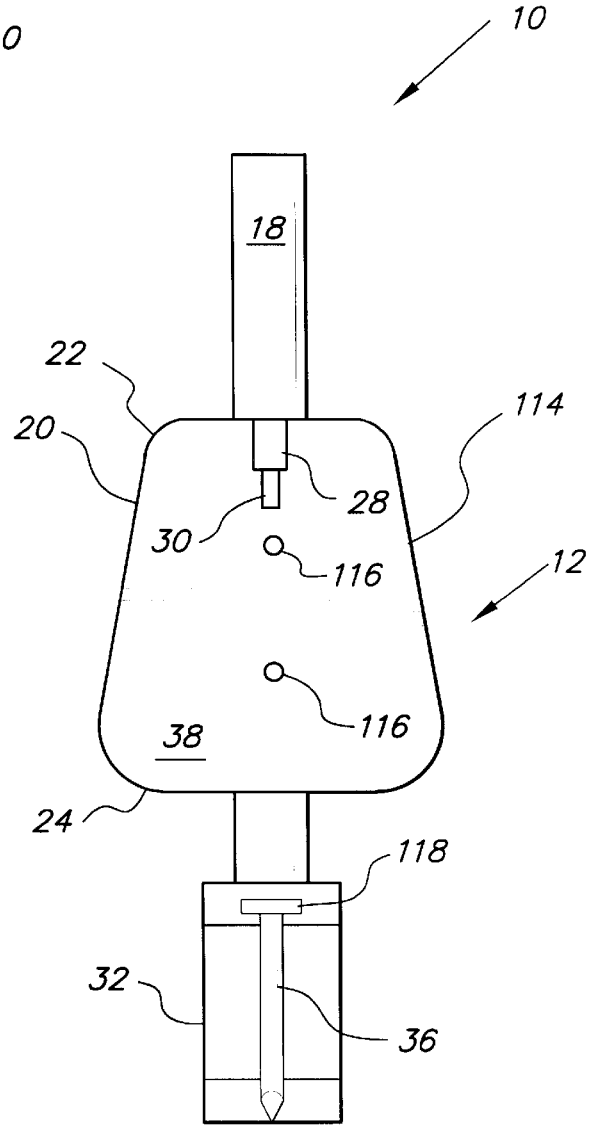
FIG. 8B is a rear view of the nailing gun casing.

FIGS. 6, 7, 8A, and 8B are schematic views of the casing 12 of electric nailing gun device 10. The front spring 78 is housed in a front stack 16 with a square cross-section. The rear spring 80 is housed in a rear stack 18 with a circular cross-section. The stacks 16, 18 are separated by a guide 82 which guides the T-nail 36 and the hammer element 84 as it slides up and down the slotted portions of the stacks 16, 18. The main body 20 of the casing 12 is shown wider at the bottom portion 24 than the top portion 22 (FIGS. 8A and 8B). The main body 20 has a rear access cover 114 removable with two fasteners 116. The nail case or magazine 32 is shown in FIG. 8B without the access cover 96 to show the track 118 for holding a bar 34 of T-nails 36.

Figure 9:
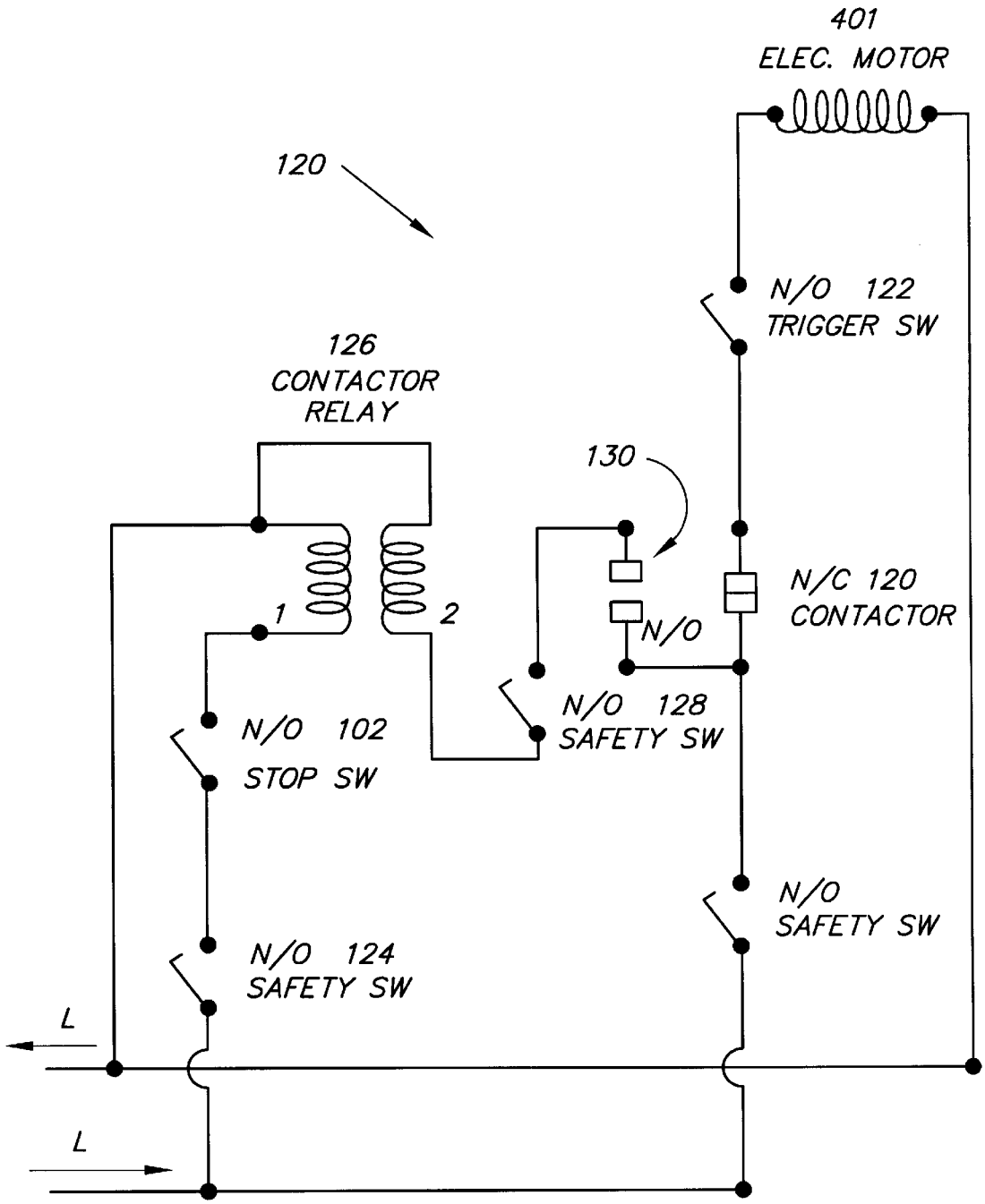
FIG. 9 is a wiring diagram of the nailing gun device.

In FIG. 9, a wiring diagram 120 of the electrical circuitry for the nailing gun device 10 is schematically illustrated. When the device 10 is pressed against an object surface to be nailed, the push button 106 of the normally open (N/O) safety switch 104 is depressed to close the safety switch. When trigger 30 is depressed to close the normally open trigger switch 122, the current i now flows through the closed safety switch 104 and the normally closed (N/C) contact portion 108 to energize the motor 40. When a reciprocating cycle of the hammer element 84 is completed, the parallel circuit with a normally open safety switch 124 and a normally open stop switch 102 which have been closed causes the contactor relay 126 to be energized. This action then causes the normally open safety switch 128 and the normally open contactor portion 130 to close, and the normally closed contact portion 120 to open to break the circuit and stop the operation of the motor 40. Simultaneously, when the normally open contact portion 130 closes, a current flows back to the contactor relay 126 to reopen the closed stop switch 102 and the closed safety switch 124, and to hold the contactor portions 120 and 130 in their positions to prevent the firing of another nail 36 in the same spot. When the device 10 is lifted from the nailed surface, the circuit returns to the condition shown in FIG. 9.

Thus, a dependable electric nailing gun 10 based on spring action and being non-pneumatic has been shown having a novel mechanism, i.e., scooper plate 46, lever 62 and triangular cam 56, for nailing T-shaped nails 36 and preventing the nailing of one nail on another.

It is to be understood that the present invention is not limited to the embodiment described above, but encompasses any and all embodiments within the scope of the following claims.

I claim:

1. An electric nailing gun device comprising:

a casing having a front end, a front vertical stack housing, a rear vertical stack housing, a main body with a top portion and a bottom portion, a front handle, a rear handle with a trigger, and a rear end for enclosing the mechanical parts of an electrical nailing gun;

an electric motor having front and rear drive axles and located in the top portion of the main body;

a circular scooper plate perpendicular to and driven by said front drive axle, and having an arcuate groove beginning from an edge as a shallow groove spiralling towards the center of said circular scooper plate;

a first cog wheel adapted to be driven by said rear drive axle;

a second cog wheel adapted to be driven by said first cog wheel and having an axle;

a triangular cam with a rounded apex and base corners and connected perpendicularly to said axle of said second cog wheel at said apex;

an elongated lever having a rear end and a front end, said front end of said lever formed with an upwardly directed lip portion;

a pivot pin as a fulcrum in a middle portion of said lever;

a spring with one end attached to said rear end of said lever and its opposite end anchored to a post;

a dual compression spring element with a front spring enclosed in said front stack housing and a rear spring enclosed in said rear stack housing;

a hammer element comprising a stem with a rectangular cross-section for driving in a nail, and having a first top portion forwardly projecting for anchoring said front spring and a second portion proximate said top base portion projecting rearwardly from said stem to anchor said rear spring;

said projecting second portion ending in a knob for interfitting said arcuate groove in said scooper plate;

a bar of T-shaped nails stored in a magazine in the lower portion of said casing; and a guide located between said pair of stack housings to guide said hammer element and said T-shaped nail;

whereby the motor in rotating the cam causes the lever to push up the hammer element to compress the dual spring element and cause its knob to contact and travel in the scooper plate, to drive in a T-shaped nail repeatedly by continual actuation of the trigger.

2. The electric nailing gun device according to claim 1, wherein said front stack housing is square in cross-section and said rear stack housing is circular in cross-section.

3. The electric nailing gun device according to claim 2, wherein an inner cylindrical housing for said rear spring fits within said rear stack housing.

4. The electric nailing gun device according to claim 1, wherein said electric motor being energized by an electrical power source selected from the group consisting of alternating current and direct current.

* * * * *